US006146082A

United States Patent [19]

York

[11] Patent Number: 6,146,082

[45] Date of Patent: Nov. 14, 2000

[54] HYDRAULIC SWIVEL CONNECTOR, EXCAVATING MACHINE AND METHOD OF USE

[76] Inventor: Rick R. York, P.O. Box 1283, Erie, Pa. 16512

[21] Appl. No.: 09/233,606

[22] Filed: Jan. 19, 1999

[51] Int. Cl.[7] ..... E02F 03/32

[52] U.S. Cl. ..... 414/723; 414/695.5

[58] Field of Search ..... 414/686, 695.5, 414/723, 726

[56] References Cited

U.S. PATENT DOCUMENTS

| | | | |
|---|---|---|---|
| 2,814,396 | 11/1957 | Neale, Sr. . | |
| 3,341,041 | 9/1967 | Salna . | |
| 3,581,924 | 6/1971 | Marz . | |
| 3,896,950 | 7/1975 | McCain | 214/138 |
| 4,156,488 | 5/1979 | Stark | 414/697 |
| 4,345,872 | 8/1982 | Arnold | 414/723 |
| 4,397,604 | 8/1983 | McCain | 414/723 |
| 4,500,250 | 2/1985 | Maurer et al. | 414/695.5 |
| 4,639,183 | 1/1987 | Guthoff | 414/723 |
| 4,925,358 | 5/1990 | Cook | 414/685 |
| 4,939,855 | 7/1990 | McCreary et al. | 414/726 |
| 5,147,173 | 9/1992 | Fauber et al. | 414/723 |
| 5,415,235 | 5/1995 | Gebauer | 172/273 |
| 5,423,625 | 6/1995 | Gebaurer et al. | 414/723 |
| 5,487,230 | 1/1996 | Weyer | 414/723 |
| 5,494,395 | 2/1996 | Raunisto | 414/694 |
| 5,515,626 | 5/1996 | Holscher | 414/723 |
| 5,850,704 | 12/1998 | Harinen | 414/723 |

*Primary Examiner*—Gregory A. Morse
*Attorney, Agent, or Firm*—Lovercheck and Lovercheck

[57] ABSTRACT

The invention provides a hydraulic swivel connector, excavating machine having hydraulic swivel connectors and methods of use thereof. The hydraulic swivel connector, comprises, a first and second hydraulic swivel cylinder each having an extendable arm, a swivel connector frame, a swivel connector rotatable member. One end of each hydraulic swivel cylinder is connected to the swivel connector frame. The other end of each hydraulic swivel cylinder is connected to the swivel connector rotatable member. Extension of one hydraulic swivel cylinder arm forces the swivel connector rotatable member to rotate in a first direction, and extension of the other hydraulic swivel cylinder arm forces the swivel connector rotatable member to rotate in a second direction.

14 Claims, 7 Drawing Sheets

HYDRAULIC SWIVEL CONNECTOR, EXCAVATING MACHINE AND METHOD OF USE

BACKGROUND OF THE INVENTION

The invention relates to hydraulic connectors, excavating machines and methods of use thereof. The invention provides a hydraulic swivel connector, excavating machine having hydraulic swivel connectors and methods of use thereof.

McCain discloses an excavating machine in U.S. Pat. No. 3,896,950 incorporated herein by reference in its entirety. McCain discloses a releasable connection in U.S. Pat. No. 4,397,604 incorporated herein by reference in its entirety.

Applicant is aware of the following U.S. Pat. Nos. 2,814,396; 3,341,041; 3,581,924; 4,156,488; 4,397,604; 4,925,358; 5,147,173; 5,415,235; 5,494,395; and, 3,896,950 which patents do not disclose the invention of the present application.

SUMMARY OF THE INVENTION

The invention provides a hydraulic swivel connector, excavating machine having hydraulic swivel connectors and methods of use thereof. The hydraulic swivel connector, comprises a first and second hydraulic swivel cylinder each having an extendible arm, a swivel connector frame, a swivel connector rotatable member.

One end of each hydraulic swivel cylinder is connected to the swivel connector frame. The other end of each hydraulic swivel cylinder is connected to the swivel connector rotatable member. Extension of one hydraulic swivel cylinder arm forces the swivel connector rotatable member to rotate in a first direction, and extension of the other hydraulic swivel cylinder arm forces the swivel connector rotatable member to rotate in a second direction. The arrangement of the rotatable member and the hydraulic cylinders permits the compact size of the connector with the cylinders contained inside the footprint of the swivel connector.

It is an object of the invention to provide a hydraulic swivel connector comprising: a first and second hydraulic swivel cylinder each having an extendible arm, a swivel connector frame, a swivel connector rotatable member.

It is an object of the invention to provide an excavating machine having a hydraulic swivel connector.

Digging means as used herein refers to earth moving implements supported by excavating machines, and includes buckets and hammers.

With the above and other objects in view; the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

BRIEF DESCRIPTION OF THE DRAWING(S)

DETAILED DESCRIPTION OF THE INVENTION

Figure 1:
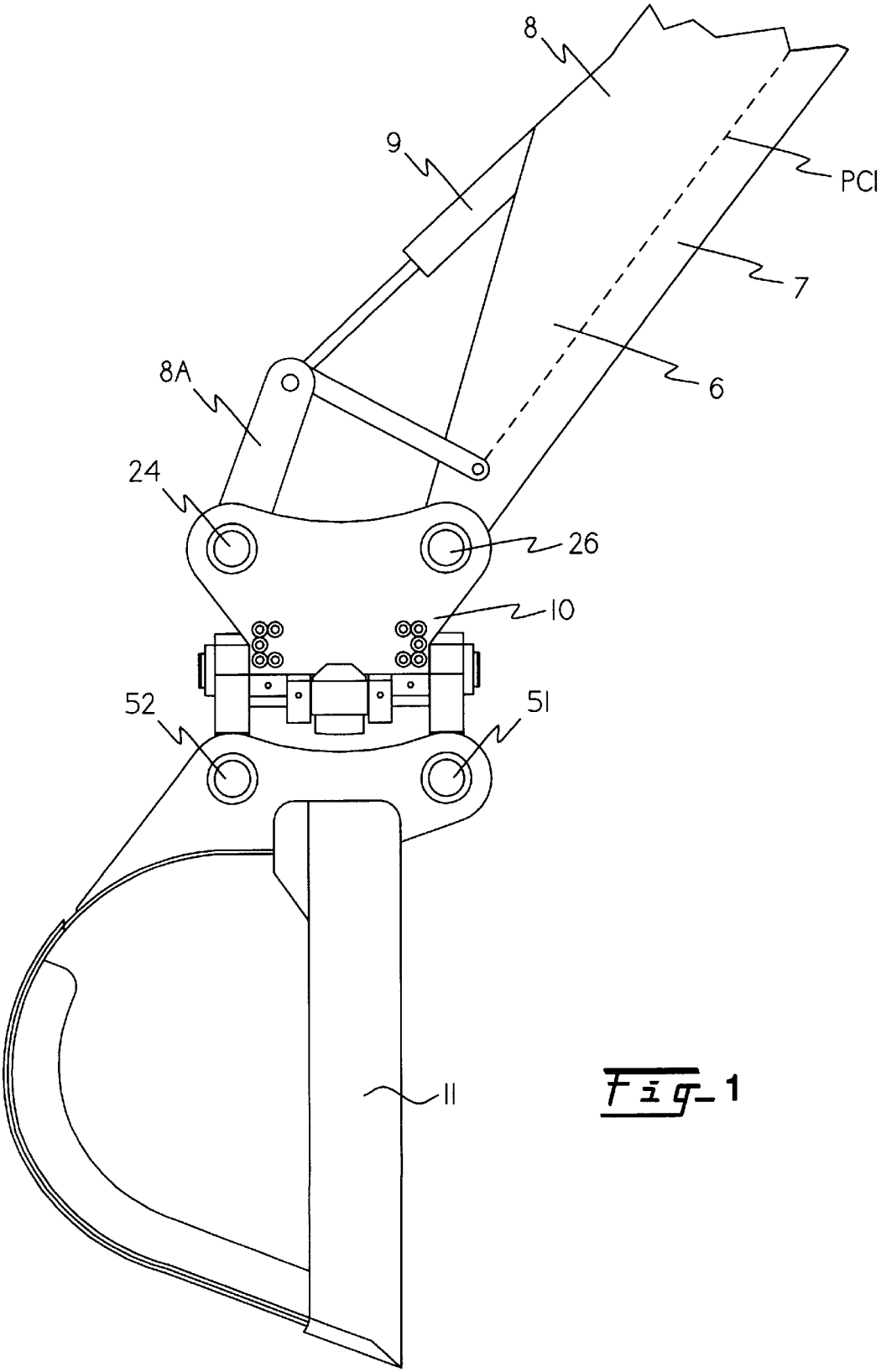
FIG. 1 is a side view of an excavating machine having a hydraulic swivel connector mounted between the stick and the bucket in accordance with the invention.
Figure 2:
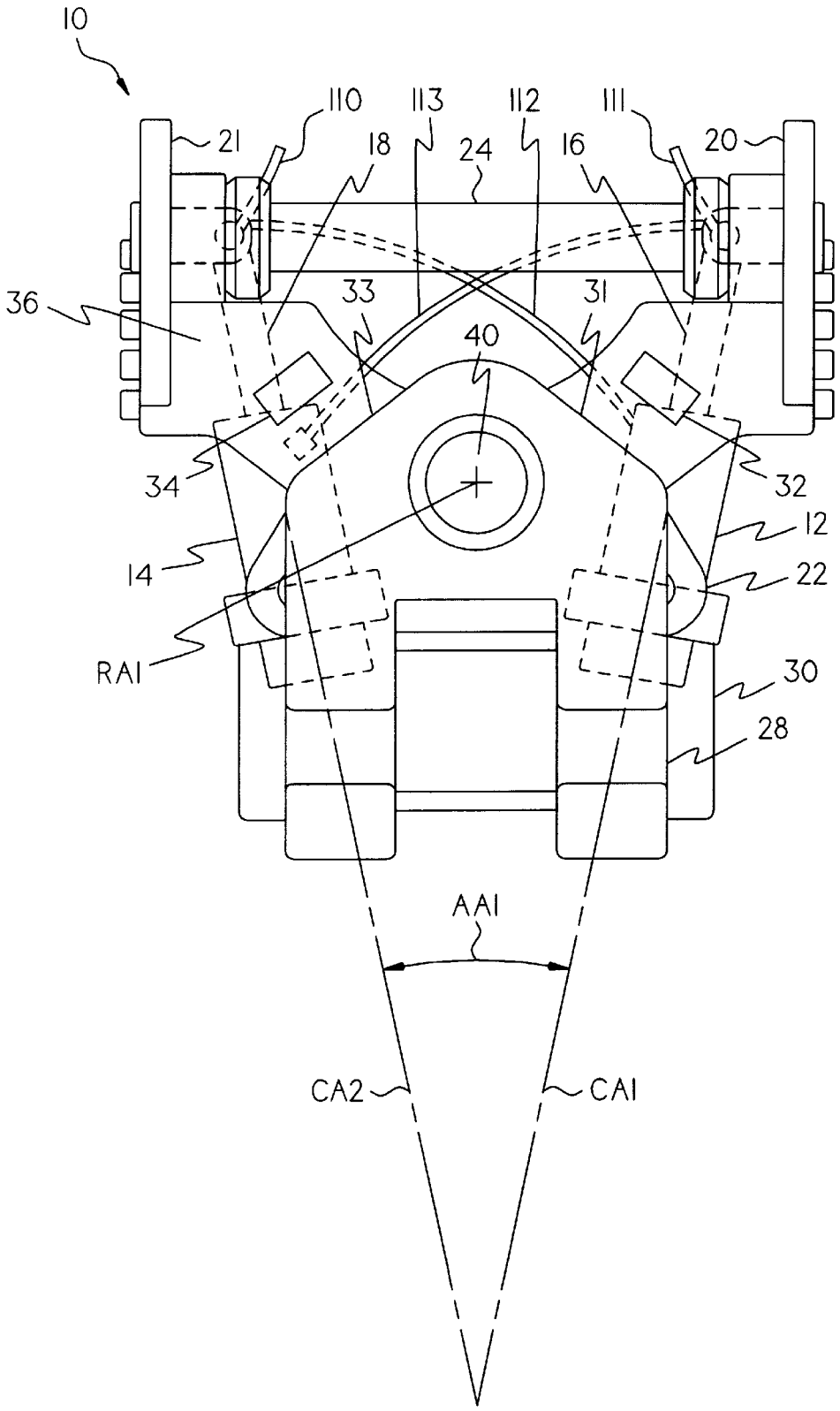
FIG. 2 is a front view of a hydraulic swivel connector, as shown in FIG. 1, in accordance with the invention.
Figure 3:
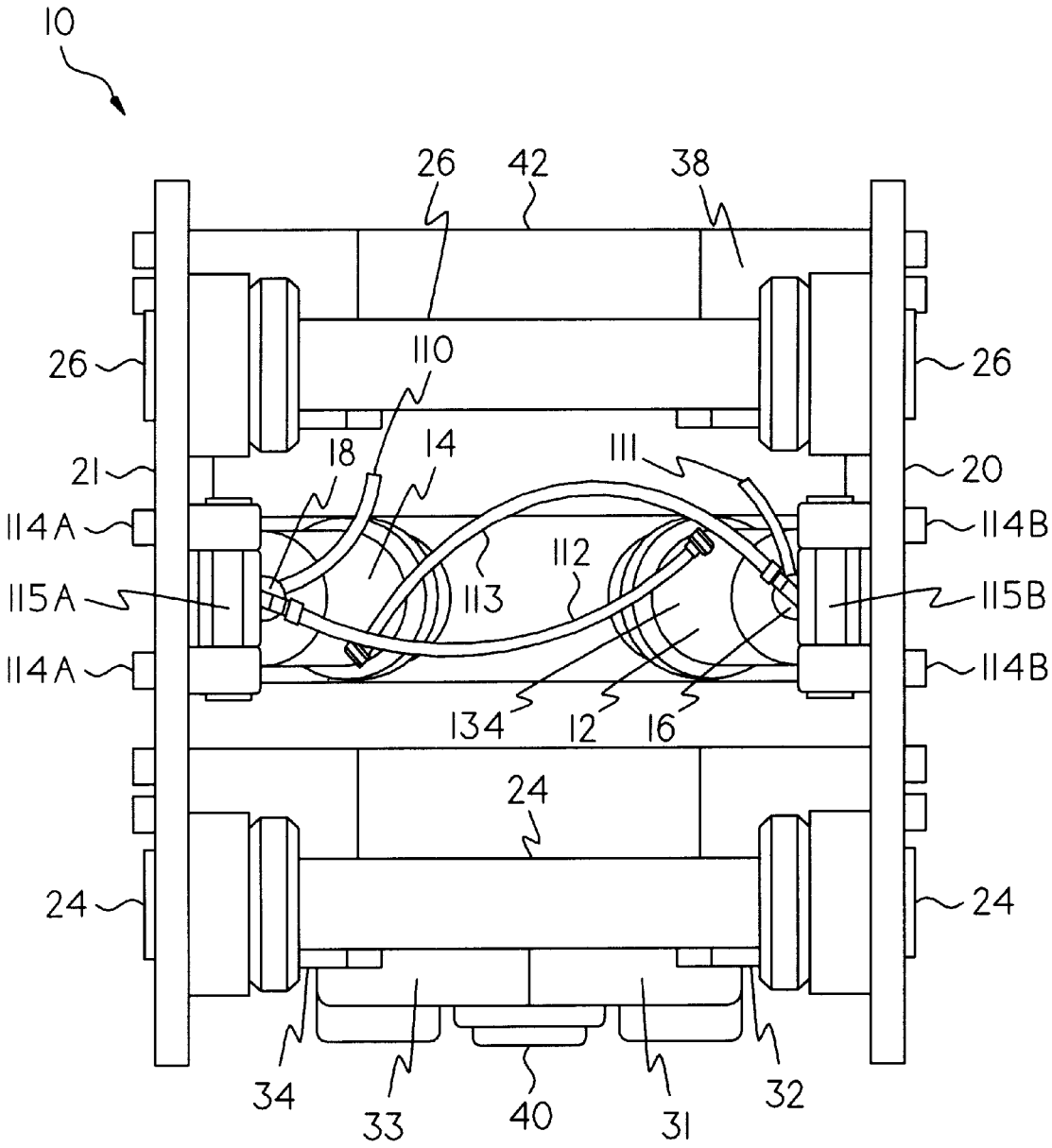
FIG. 3 is a top or stick end view of the hydraulic swivel connector shown in FIG. 2.
Figure 4:
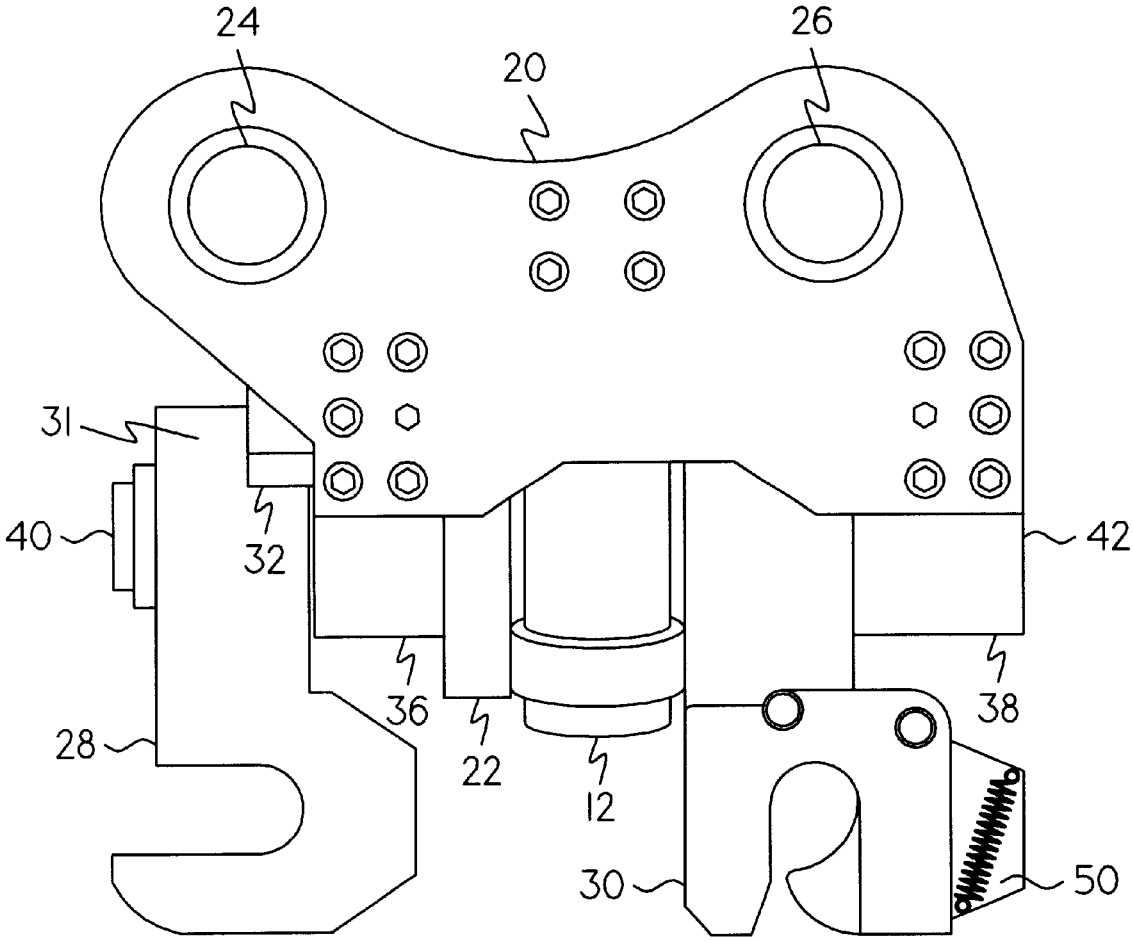
FIG. 4 is a side view of the hydraulic swivel connector, shown in FIG. 2, with the connector swiveled to the left side and an arrow indicating the range of swivel.
Figure 5:
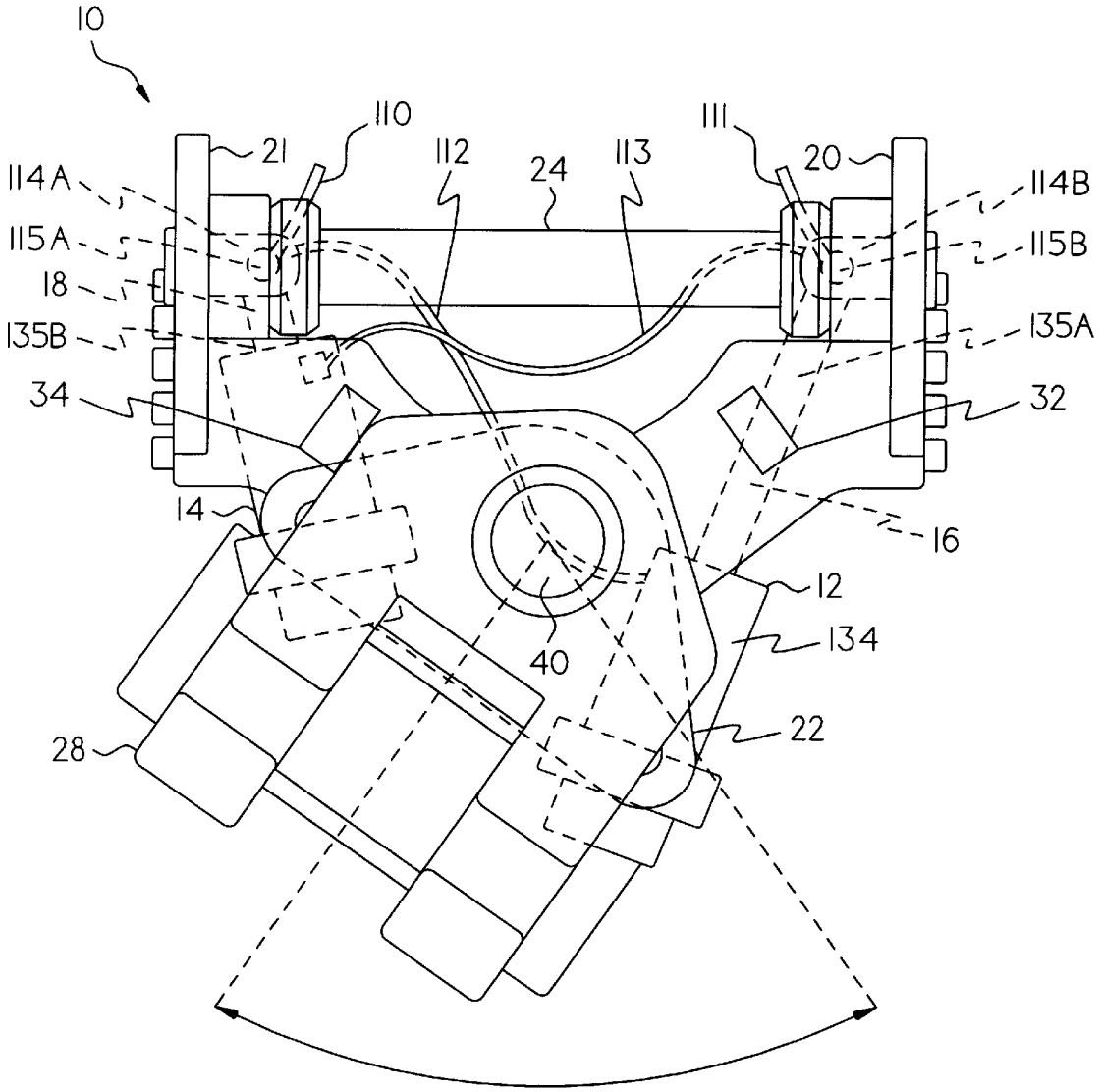
FIG. 5 is a front view of the hydraulic swivel connector shown in FIG. 2.
Figure 6:
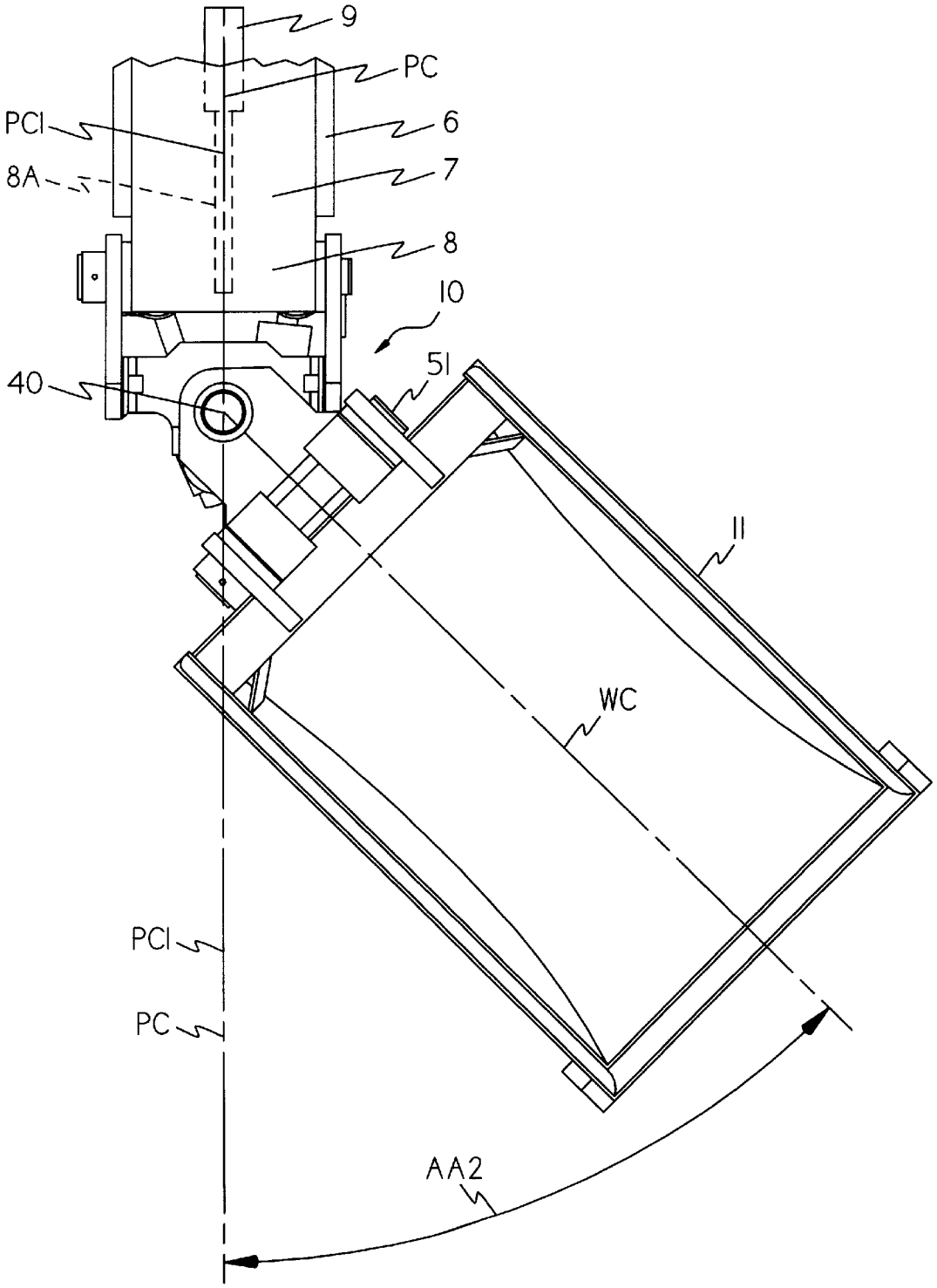
FIG. 6 is a front view of the hydraulic swivel connector shown in FIG. 2 connected to a bucket.
Figure 7:
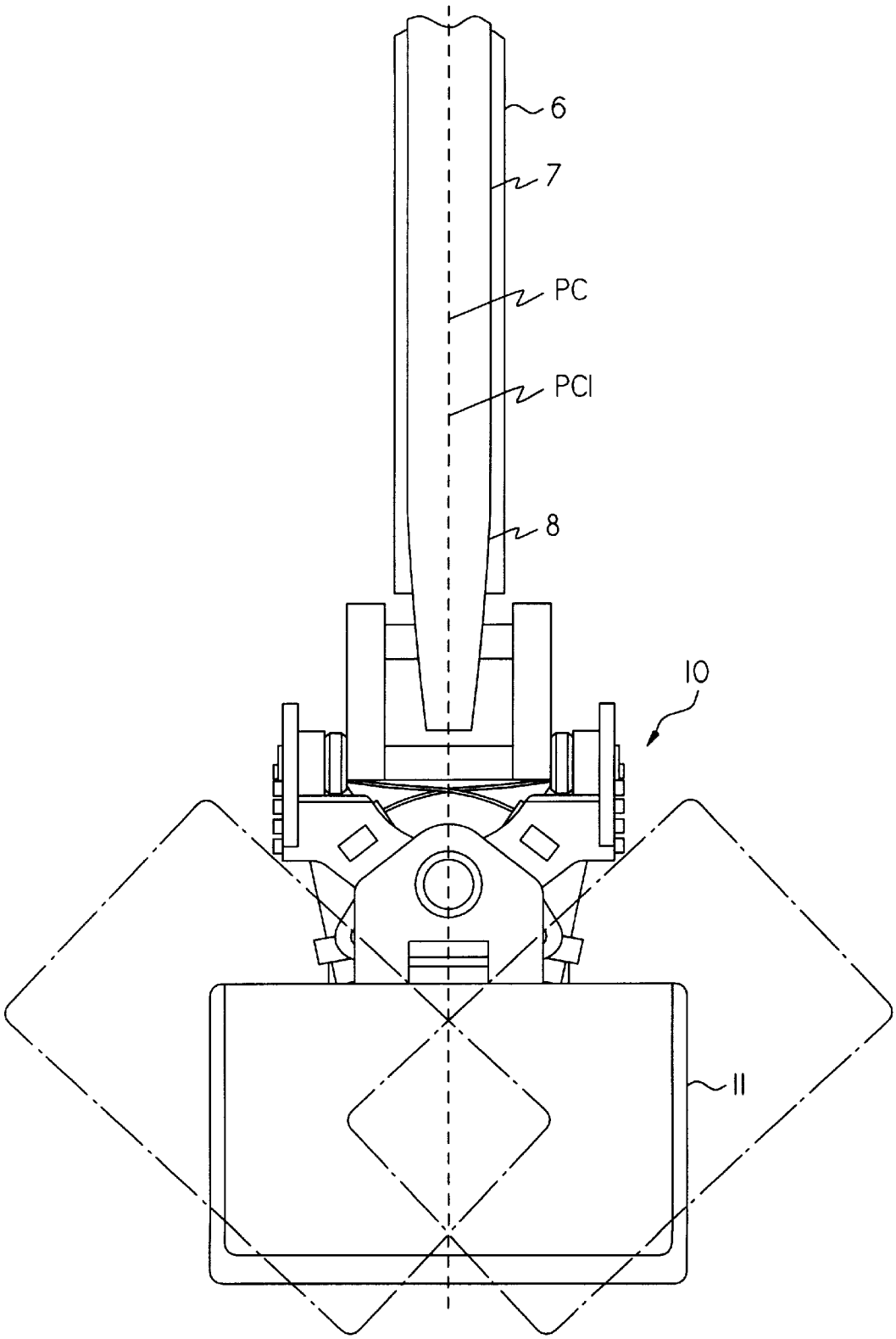
FIG. 7 is a side view of the hydraulic swivel connector shown in FIG. 2 connected to a stick and having a bucket mounted thereon, illustrated in a centered position and indicating in phantom lines the range of swivel of the bucket to each side.

The invention is now described with more particular reference to FIGS. 1 through 7. With more particular reference to FIG. 1 is seen hydraulic swivel connector 10 connected to dipper stick 7 having structural members 6 and 8 and supporting bucket 11. Elongated structural member 6 is connected to elongated structural member 8. Structural member 6 and structural member 8 are connected to hydraulic cylinder 9 which moves hydraulic swivel connector 10. Structural member 8 supports hydraulic swivel connector 10. Hydraulic swivel connector 10 is connected to and supports bucket 11.

With more particular reference to FIGS. 2 through 7 is seen hydraulic swivel connector 10 having fixed and secured hydraulic swivel cylinders 12 and 14 having extendible cylinder arms 16 and 18, swivel connector 10 has first swivel connector side member frame 20, second swivel connector side frame 21, and swivel connector rotatable member 22. Swivel connector side frame members 20 and 21 have brackets 114A and 114B attached thereto respectively. Hydraulic swivel cylinders 12 and 14 are connected to swivel connector side frame members 20 and 21 by pins 115A and 115B and brackets 114A and 114B. Hydraulic swivel cylinders 12 and 14 are connected to swivel connector rotatable member 22. Extension of hydraulic swivel cylinder arm 16 forces swivel connector rotatable member 22 to rotate in a first direction and the retraction of hydraulic cylinder arm 18, and retraction of hydraulic swivel cylinder arm 18 extension of hydraulic swivel cylinder arm 18 forces swivel connector rotatable member 22 to rotate in a second direction and retraction of hydraulic swivel cylinder arm 16.

Hydraulic swivel connector 10 supports bucket 11 from a dipper stick 7. Elongated structural member 8 and links 8A are connected to pins 24 and 26 of hydraulic swivel connector 10. Pins 24 and 26 are connected to swivel connector side frame members 20 and 21 and extend therebetween. Swivel connector side frame members 20 and 21 are connected to swivel connector end frame members 36 and 38. In use rotatable hook member 28 and bucket support 30 of hydraulic swivel connector 10 are connected to bucket 11. Links 8A correspond to links (19) in US Patent 3,896,950 which provides an additional discussion of connection to a dipper stick.

Swivel connector rotatable member 22 is supported by cylindrical support member 40. Cylindrical support member 40 extends through, is rotatable within and is supported by swivel connector end frame member 36. Hook member 28 is supported by cylindrical support member 40.

Bucket support 30 is supported by cylindrical support member 42. Cylindrical support member 42 extends through, is rotatable within and is supported by swivel connector end frame member 38.

Extension of hydraulic swivel cylinder arm 16 forces swivel connector rotatable member 22 to rotate in a first direction until upper face 31 of hook member 28 engages stop 32. Extension of hydraulic swivel cylinder arm 18 forces swivel connector rotatable member 22 to rotate in a second direction until upper face 33 of hook member 28 engages stop 34. Stops 32 and 34 are connected to swivel connector end frame member 36.

Bucket support 30 and hook 28 are adapted to swingably and removably support an excavator and/or backhoe bucket. Bucket support 30 includes a releasable mechanism 50 for releasing and attaching the bucket from the bucket support. The releasable mechanism is made up of a first forwardly facing hook for receiving the front support pin 51 of the bucket and a downwardly facing notch which receives the rear pin on the bucket, and a second hook attached to the bucket support that swings under the rear pin 52 of the bucket when it is supported in the downwardly facing slot notch.

Bucket support 30 is adapted for supporting a bucket on a backhoe dipper stick of an earthmoving machine. When a bucket is supported by bucket support 30 of hydraulic swivel connector 10 the combination is capable of side dumping.

Bucket support 30 comprising two spaced support plates fixed to its sides and extending downwardly therefrom, a downwardly opening slot in each the spaced support plates, at least one bucket support hook disposed between the spaced support plates and pivot means swingably connecting the hook to the spaced support plates, the bucket support hook having a forwardly opening slot, the bucket support hook being adapted to swing under a pin 52 supported in the vertically extending slots, a laterally extending bar attached to the bucket support hook and extending laterally thereof and a handle attached to the bar, two spaced helical tension springs attached at their upper end to the bar, the lower end of the springs being attached to means on the support plates, the springs urging the second bucket support hook to swing to closed position.

Hydraulic oil enters the cylinder rod and piston assembly 135A through hydraulic hose 111. Cylinder pin 115B restricts the movement of cylinder rod and piston assembly 135A. Because movement of cylinder rod and piston assembly 135A is restricted by pin 115B the pressure within the assembly moves cylinder barrel 134 downward. As cylinder barrel 134 downward energy is transmitted through trunnions into torque plates 105A and 105B through four trunnion bushings 107. The trunnions are welded to cylinder barrel 134.

Force and power are transmitted from torque plates 105A and 105B through torque shafts 102A and 102B to rear latch assembly 119 and front hook assembly 120 through torque shift keys 127A and 127B. Torque shafts 102A and 102B are held stationary by bearing housings 121A and 121B which rotate on torque shaft bearings 122A and 122B and are held in place by locking collars 101A and 101B and by torque plate spring pin 106. Thrust washers 103 and 104 reduce the friction of rotation. Rotation can be stopped at any point in the 90 degrees of rotation range. Rotation is stopped at 45 degrees from center by stop blocks 118. Stop blocks 118 are held to bearing housings 121A and 121B by welds and pins.

Hydraulic oil enters the cylinder rod and piston assembly 135A through hose 111 forcing cylinder barrel 136 to extend. As hydraulic oil enters the cylinder rod and piston assembly 135A this displaces oil from the opposite side in the rod piston and assembly 135B causing it to go back to rod and piston assembly 135A through hose 113 and to tank through hydraulic hose 110. Hydraulic oil which is being displaced in cylinder barrel 134 the hydraulic oil is sent through hydraulic hose 112 into cylinder rod and piston assembly 135B and is also sent to tank through hydraulic hose 111.

Side plates 117 are held by bolts 131 to bearing housings 121A and 121B. Pins 130 hold front and back movement of side plate keys 128. Side plate keys 128 keep side plates 117 in place with bearing housings 121A and 121B, and prevent bolts 131 from shearing under pressure from hydraulic cylinders 12 and 14. These movements are reversed by passing hydraulic oil through hose 110.

Bolts 133 locate and clamp rear latch assembly 119 and front hook assembly 120 to torque shafts 102A and 102B. Latch 125 is supported by rear latch assembly 119. Latch pin 123 is held in place by snap ring 124. Latch 125 rotates counterclockwise on latch pin 123 when pressure is applied to latch 125 by a PIN. Spring 126 stretches until the PIN enters the pocket, then spring 126 contracts causing latch 125 to rotate clockwise on latch pin 123 and capture the PIN. Stop bar 129 retards the rotation as it comes into contact with rear latch assembly 119.

Thus, the invention provides hydraulic swivel connector 10, comprising: a first and second hydraulic swivel cylinder each having an extendable arm, a swivel connector frame, a swivel connector rotatable member.

One end of each hydraulic swivel cylinder is connected to the swivel connector frame. The other end of each hydraulic swivel cylinder is connected to the swivel connector rotatable member. Extension of one hydraulic swivel cylinder arm forces the swivel connector rotatable member to rotate in a first direction, and extension of the other hydraulic swivel cylinder arm forces the swivel connector rotatable member to rotate in a second direction. The first direction is substantially opposite to the second direction. The swivel connector 10 rotates around a bucket support rotational axis RA1. The hydraulic swivel cylinders 12 and 14 each have a central axis. The hydraulic swivel cylinder central axis CA1 and the hydraulic swivel cylinder central axis CA2 intersect below the bucket support rotational axis at acute angle AA1.

Bucket support 30 for supporting bucket 11 has two spaced support plates fixed to its sides and extending downwardly therefrom, a downwardly opening slot in each the spaced support plates, a first hook disposed between the spaced support plates and pivot means swingably connecting the first bucket support hook to the spaced support plates. The first bucket support hook has a forwardly opening slot. The first bucket support hook is adapted to swing under a pin supported in the vertically extending slots. A laterally extending bar is attached to the first bucket support hook and extends laterally thereof and a handle is attached to the bar, two spaced helical tension springs are attached at their upper end to the bar, the lower end of the springs are attached to means on the support plates, the springs urge a second bucket support hook to swing to closed position. The rotatable hook has a forwardly opening slot in its lower end adapted to receive a pin of a backhoe bucket.

With more particular reference to FIGS. 5, 1, 6 and 7 is seen dipper stick 7 is seen having substantially straight center lines PC and PC1 of dipper stick structural members 6 and 8 in the same plane. Swivel connector is adapted to rotate the digging means laterally relative to the dipper stick center lines PC and PC1 and the dipper stick work end, whereby the center line WC of the digging means intersects the plane of the dipper stick structural members 6 and 8 center lines PC and PC1 at only one point. Center line WC of the digging means intersects the plane of dipper stick structural members center lines PC and PC1 at acute angle AA2.

In a preferred embodiment of the invention a cylinder is connected to the dipper stick to swing a bucket about a laterally extending axis. As discussed in U.S. Pat. Nos. 3,896,950 and 4,397,604 the bucket support has downwardly extending lugs which pivotally receive a king pin. The king pin is also received in the upwardly extending lugs connected to a tilt support and fixed to them. The king pin has crank arms fixed to an intermediate part of it and the crank arms are connected to the piston rod of a tilting cylinder which is supported on the bucket support. The tilting cylinder will tilt the bucket about the axially extending king pin. The tilt support has a pivot member connected to it and the pivot member is connected to a bucket bracket. The bucket bracket pivotally supports links that are fixed the buckets.

It should be understood that while the present invention has been described in considerable detail with respect to certain specific embodiments thereof it should not be considered limited to such embodiments but may be used in other ways without departure from the spirit of the invention and scope of the appended claims.

The embodiments of the invention in which an exclusive property or privilege is claimed are defined as follows:

1. A hydraulic swivel connector, comprising: a first hydraulic swivel cylinder having a first arm, a second hydraulic swivel cylinder having a second aim, a swivel connector frame, a swivel connector rotatable member, a first end of said first hydraulic swivel cylinder being connected to said swivel connector frame, a second end of said first hydraulic swivel cylinder being connected to said swivel connector rotatable member, a first end of said second hydraulic swivel cylinder being connected to said swivel connector frame, a second end of said second hydraulic swivel cylinder being connected to said swivel connector rotatable member, whereby extension of said first hydraulic swivel cylinder arm forces said swivel connector rotatable member to rotate in a first direction, and extension of said second hydraulic swivel cylinder arm forces said swivel connector rotatable member to rotate in a second direction;

a bucket support for supporting a bucket, said bucket support comprising, two spaced support plates fixed to its sides and extending downwardly therefrom, a downwardly opening slot in each said spaced support plates, a first bucket support hook disposed between said spaced support plates and pivot means swingably connecting said first bucket support hook to said spaced support plates, said first bucket support hook having a forwardly opening slot, said first bucket support hook being adapted to swing under a pin supported in said vertically extending slots, a laterally extending bar attached to said first bucket support hook and extending laterally thereof and a handle attached to said bar, two spaced helical tension springs attached at their upper end to said bar, the lower end of said springs being attached to means on said support plates, said springs urging a second bucket support hook to swing to closed position;

a dipper stick, said dipper stick having a dipper stick base end connected to a rotatable base, said dipper stick having a dipper stick work end connected to said swivel connector frame, said dipper stick comprising first and second dipper stick arms and a first dipper stick hydraulic, cylinder said dipper stick hydraulic cylinder being connected to said first and second dipper stick arms said dipper stick being adapted to extend said bucket relative to said rotatable base said swivel connector rotatable member being adapted to rotate said bucket relative to said dipper stick work end.

2. The swivel connector of claim 1 wherein said first direction is substantially opposite to said second direction.

3. The swivel connector of claim 1 wherein said dipper stick axis intersects a bucket support rotational axis, said first and said second hydraulic swivel cylinders each have a central is, said first hydraulic swivel cylinder central axis and said second hydraulic swivel cylinder central axis each intersect said dipper stick axis at an acute angle.

4. The combination recited in claim 1 wherein said swivel connector has spaced side plates fixed thereto and extending upwardly therefrom, said dipper stick is connected to said swivel connector by means connected to said upwardly extending side plates.

5. The combination recited in claim 1 further comprising an engine driven vehicle having a frame, and said dipper stick is supported by said frame.

6. The combination recited in claim 1 wherein hydraulic oil enters the first cylinder rod and piston assembly of said first hydraulic swivel cylinder through a first hydraulic hose, and movement of said first cylinder rod and piston assembly is restricted whereby pressure within said first cylinder rod and piston assembly moves a first cylinder barrel downward, forcing trunnions, torque plates, rear latch assembly and front hook assembly to rotate on torque shaft bearings.

7. The combination recited in claim 6 wherein said rotating is adapted to be stopped at a point within 90 degrees of rotation range.

8. The combination recited in claim 6 wherein said rotating is adapted to be stopped at 45 degrees from center by a stop block.

9. A hydraulic swivel connector, comprising: a first hydraulic swivel cylinder having a first arm, a second hydraulic swivel cylinder having a second arm, a swivel connector frame, a swivel connector rotatable member, a fist end of said first hydraulic swivel cylinder being connected to said swivel connector frame, a second end of said first hydraulic swivel cylinder being connected to said swivel connector rotatable member, a first end of said second hydraulic swivel cylinder being connected to said swivel connector frame, a second end of said second hydraulic swivel cylinder being connected to said swivel connector rotatable member, whereby extension of said first hydraulic swivel cylinder aim forces said swivel connector rotatable member to rotate in a first direction, and extension of said second hydraulic swivel cylinder arm forces said swivel connector rotatable member to rotate in a second direction;

a bucket support for supporting a bucket, said bucket support comprising, two spaced support plates fixed to its sides and extending downwardly therefrom, a downwardly opening slot in each said spaced support plates, a first bucket support book disposed between said spaced support plates and pivot means swingably connecting said first bucket support hook to said spaced support plates, said fi( bucket support hook having a forwardly opening slot, said first bucket support hook being adapted to swing under a pin supported in said vertically extending slots, a laterally extending bar attached to said first bucket support hook and extending laterally thereof and a handle attached to said bar, two spaced helical tension springs attached at their upper end to said bar, the lower end of said springs being attached to means on said support plates, said springs urging a second bucket support hook to swing to closed position;

said bucket is supported by said bucket support hook and said swivel hook, said bucket support hook being supported by a first trunnion, and said swivel hook being supported by a second trunnion.

10. The combination recited in claim 9 wherein said swivel connector has spaced side plates fixed thereto and extending upwardly therefrom, said dipper stick is connected to said swivel connector by means connected to said upwardly extending side plates.

11. The combination recited in claim 9 further comprising an engine driven vehicle having a frame, and said dipper stick is supported by said frame.

12. The combination recited in claim 9 wherein hydraulic oil enters the first cylinder rod and piston assembly of said first hydraulic swivel cylinder through a first hydraulic hose, and movement of said first cylinder rod and piston assembly is restricted whereby pressure within said first cylinder rod and piston assembly moves a first cylinder barrel downward, forcing trunnions, torque plates, rear latch assembly and front hook assembly to rotate on torque shaft bearings.

13. The combination recited in claim 12 wherein said rotating is adapted to be stopped at a point within 90 degrees of rotation range.

14. The combination recited in claim 12 wherein said rotating is adapted to be stopped at 45 degrees from center by a stop block.

* * * * *